United States Patent [19]

White

[11] 4,176,044

[45] Nov. 27, 1979

[54] PROCESS FOR ALKYLATING WAXY HYDROCARBONS WITH $C_3$–$C_5$ CARBON ATOM SECONDARY ALCOHOLS AS CATALYST

[75] Inventor: Anthony M. White, Brights Grove, Canada

[73] Assignee: Exxon Research & Engineering Co., Florham Park, N.J.

[21] Appl. No.: 908,525

[22] Filed: May 22, 1978

Related U.S. Application Data

[63] Continuation of Ser. No. 824,276, Aug. 15, 1977, abandoned.

[51] Int. Cl.[2] ..... C10G 23/52

[52] U.S. Cl. ..... 208/46

[58] Field of Search ..... 208/46, 24, 27, 18; 260/683.43

[56] References Cited

U.S. PATENT DOCUMENTS

| | | | |
|---|---|---|---|
| 2,378,763 | 6/1945 | Frey | 208/18 |
| 2,463,262 | 3/1949 | Goldsby | 260/683.43 |
| 2,741,649 | 4/1956 | Abbott et al. | 208/46 |

*Primary Examiner*—George J. Crasanakis

*Attorney, Agent, or Firm*—Edward M. Corcoran

[57] ABSTRACT

Waxy, normally solid hydrocarbons are alkylated to form liquid hydrocarbons boiling in the lube oil range by contacting the wax and a low molecular weight olefin, such as ethylene, with a catalyst comprising a $C_3$–$C_5$ carbon atom secondary alcohol at elevated temperature and pressure. This process is useful for making relatively high VI lube oils from wax, for decreasing the pour point of jet fuels and for dewaxing lube oil feedstocks.

14 Claims, No Drawings

PROCESS FOR ALKYLATING WAXY HYDROCARBONS WITH $C_3$–$C_5$ CARBON ATOM SECONDARY ALCOHOLS AS CATALYST

This is a continuation of application Ser. No. 824,276, filed Aug. 15, 1977 and now abandoned.

BACKGROUND OF THE INVENTION

1. Field of the Invention

This invention relates to a process for alkylating wax to liquid materials boiling primarily in the lube oil range. More particularly, this invention relates to a process for alkylating waxy, normally solid hydrocarbons to liquid hydrocarbons boiling primarily in the lube oil range, by contacting the wax and a low molecular weight olefin, such as ethylene, with a catalyst comprising one or more $C_3$–$C_5$ carbon atom secondary alcohols at elevated temperature and pressure.

2. Description of the Prior Art

It is well known in the art to dewax wax-containing mineral oils, particularly the lube oil fractions of petroleum oils, in order to remove at least a portion of the wax therefrom to obtain a dewaxed oil of reduced pour point. For many years this wax has been removed via various solvent dewaxing processes. In solvent dewaxing processes, the temperature of the wax-containing oil is lowered sufficiently to precipitate the wax therefrom as solid crystals of wax. At the same time, solvents are added to the waxy oils in order to improve the fluidity and reduce the viscosity thereof so that various filtration processes can be used to separate the wax from the dewaxed oil. Generally, the wax filtration temperature must be around 10° or 20° F. lower than the pour point requirement of the dewaxed oil due to a phenomenon known as pour-filter temperature inversion.

More recently, it has been found that certain zeolite type materials such as the hydrogen form of mordenite, commonly referred to in the art as decationized or H-mordenite, and certain ZSM-type crystalline aluminosilicates are effective in catalytically dewaxing petroleum oil fractions such as lube oil fractions. Thus, U.S. Pat. Nos. 3,516,925 and 3,539,498 disclose catalytically dewaxing lube oil fractions over a hydrogen form of mordenite, while U.S. Pat. No. 3,700,585 discloses the use of crystalline aluminosilicates of the ZSM-5 and ZSM-8 types for catalytically dewaxing hydrocarbon fractions such as jet fuels and lube oil fractions. These catalytic dewaxing processes are particularly useful for producing lube oils of especially low pour point which is required for certain specialty applications such as transformer oils, refrigerator oils and aviation turbine oils. However, disadvantages associated with these catalytic dewaxing processes include the fact that significant quantities of hydrogen are consumed by the process, which hydrogen must be added to the reaction zone and the wax is cracked down into low molecular weight fractions which are normally gaseous at room temperature and atmospheric pressure. Thus, these processes consume significant quantities of hydrogen and convert the wax to relatively non-valuable, gaseous by-products. Further, these catalysts are susceptible to poisoning and the VI of the catalytically dewaxed oil is substantially lower than that of the feed. It would be of value if one could catalytically dewax lube oil fractions and, at the same time, convert the wax into useful lube oil products. Further, it would be advantageous to be able to convert petroleum waxes in general to useful lube oil products.

One such process was disclosed in U.S. Pat. No. 2,741,649 which relates to a process for forming lubricating oils from waxy, normally solid hydrocarbons via an alkylation reaction comprising reacting the wax with a low molecular weight olefin such as ethylene in the presence of halogen-containing catalysts such as chloroform to produce useful lube oil products from the wax. However, introduction of halogens into a process (even if these halogens are present in halogen-containing hydrocarbons such as chloroform), results in severe corrosion problems in refinery processing equipment and if residual halogen-containing material remains in the product, this can cause severe corrosion problems in service. Hence, processes using such halogen-containing catalysts are undesirable from the standpoint of both processing and product quality.

Isomerization using noble metal catalysts has been found to be somewhat effective with refined waxes, but not with waxes in the presence of oil. Therefore, it would be desirable to provide a catalytic dewaxing process that possesses the required degree of selectivity for converting waxy molecules into lubricating oil components in the presence of oil molecules without generating or introducing corrosive materials into either the processing equipment or product.

SUMMARY OF THE INVENTION

A process for alkylating normally solid, waxy hydrocarbons to liquid hydrocarbons boiling primarily in the lube oil range has now been discovered which comprises contacting the wax and a low molecular weight olefin with a catalyst comprising one or more $C_3$–$C_5$ carbon atom secondary alcohols at elevated temperature and pressure to convert a substantial portion of the wax to relatively high VI, low pour point lube oil components. Still further, it has been found that the process of this invention is useful for alkylating wax to lube oil components even when the wax is in the presence of a lube oil fraction. Thus, this invention is also useful for at least partially dewaxing lube oil fractions thereby reducing the pour point thereof.

The waxy hydrocarbons to be reacted with the olefin can be any waxy hydrocarbon which is solid at room temperature and which is derived from various petroleum oil fractions, natural crude oil or synthetic crude oil. Included within this category are paraffin waxes, microcrystalline waxes, petrolatum and slack waxes obtained from various petroleum oil fractions, natural crude oils and synthetic crude oils derived from tar sands, coal, shale oil and the like. When the process of this invention is used to reduce the wax content of lube oil fractions, it is understood that the lube oil fraction will be predominately paraffinic in character and boil within the broad range of from about 500° to 1300° F. and more preferably between about 550° and 1200° F. These lube oil fractions may come from any paraffinic source such as the crudes obtained from Aramco, Kuwait, the Pan Handle, Louisiana, Alberta, the North Sea, etc., as well as synthetic crudes derived from Athabasca tar sands, coal, shale oil, and the like.

Olefin reactants useful in this invention are mono-olefins containing from 2 to 10 carbon atoms in the molecule. It is preferable to use normally gaseous monoolefins containing from 2 to 5 carbon atoms in the molecule such as ethylene, propylene, butene-1, butene-2 and isobutene. These olefins may be used either singly or as a mixture. Particularly preferred is ethylene. Other examples of olefin reactants which may be used either alone or in combination with others in the process of the instant invention are illustrated by pentene-1, pentene-2, 2-methylbutene-1, cyclopentene, cyclohexene, 3-methylbutene-1, 2-methylbutene-2, hexene-1, 3-methylpentene-2, heptene-1, octene-1, octene-2, decene-1 and decene-2.

Catalysts useful in this invention comprise secondary, lower molecular weight alcohols having from 3 to 5 carbon atoms in the molecule such as isopropanol, secondary butanol, 2-pentanol, 3-pentanol and the like.

In carrying out the alkylation reaction of this invention between the wax and olefin, the ratio of olefin to wax in the reaction zone may range from about 1 to 100 and preferably 2 to 10 moles of olefin per mole of wax. The amount of $C_3$–$C_5$ carbon atom secondary alcohol catalyst used in the reaction zone will vary from about 0.1 to 10 wt.% of the wax in the reaction zone and more preferably from about 0.5 to 5 wt.%. It is to be understood of course that the amount of catalyst employed in the reaction zone will vary somewhat depending on the nature of the reactants as well as upon the particular alcohol or mixture of alcohols used as a catalyst. Suitable alkylating reaction conditions include temperatures within the broad range of 300° to 1000° F., preferably 450° to 850° F., and still more preferably 600° to 750° F. at pressures ranging from between about 100 to 5000 psig, more preferably 200 to 1000 psig and still more preferably between 700 and 900 psig. These pressures will normally be provided in large part by the gaseous olefin reactants in the reaction zone, although nitrogen, carbon dioxide, hydrogen, methane, ethane or other gases which are inert with respect to the feed, product and reaction may be used to provide part of the pressure in the reaction zone. The reaction time or residence time in the reactor will vary from about 1 to 30 hours and more preferably from 15 to 20 hours.

The alkylation reaction of this invention is essentially a liquid phase reaction and accordingly, therefore, agitation of the reaction mixture will be found to be advantageous. The reaction may be carried out batchwise, semi-continuously or continuously in manners well known to those skilled in the art. However, it is important to avoid too high a concentration of olefins in the reaction zone at any one time in order to minimize the disadvantageous competing side reaction which is polymerization of the olefin. Accordingly, therefore, the amount of olefin charged to the reaction zone at any one particular time will range between about 5 to 40 wt.% of the total olefins to be charged and more preferably between about 10 to 20% of the total olefins to be charged at any one time. Therefore, if the reaction is carried out continuously, it is preferred to use an elongated reaction zone into which the olefin is added to the zone in successive increments, longitudinally along said zone as the reaction mixture progresses therethrough, thereby avoiding too high a concentration of olefins at any point within the reactor. For the sake of convenience, the reaction product will hereinafter be referred to as alkylate oil. When the feed to the reaction zone is a wax, the alkylation products from the reaction zone will comprise from 70 to 90 wt.% of the wax-olefin alkylate lube oil and from about 10 to 30% of olefin polymer along with minor amounts (i.e., up to about 4 or 5 wt.%) of various other materials such as unreacted waxes, cracked waxes and the like. The alkylate oil will have a pour point ranging from between about 50° to 100° F. with a VI approximately that of the feed. A wax feed will typically yield an alkylate oil having a VI of from about 130 to 150, while a waxy oil will yield an alkylate oil with a lower VI. The viscosity of this alkylate oil will generally be about the same as that of the feed, provided that the product oil is stripped to remove light ends boiling below the initial boiling point of the feed. It is to be understood of course that the pour point of a lube oil fraction dewaxed by the process of this invention will depend upon the extent of the alkylation reaction as well as the pour point of the initial waxy feed.

In any event, the reaction product along with any lube oil initially present in the feed is first passed to a gas separation zone wherein the gaseous components, such as unreacted olefins, are removed and recycled back to the reaction zone and then passed to a hydrorefining zone to remove any residual unsaturation in the oil as well as clean it up for color and oxidation stability after which it may be sent to storage or to additional dewaxing operations. Alternatively, the reaction product may be further dewaxed prior to hydrorefining.

DESCRIPTION OF THE PREFERRED EMBODIMENTS

The following examples illustrate the operation of the instant invention.

EXAMPLE 1

In this example, the waxy feed was a solvent extracted raffinate of a Western Canadian crude boiling between about 800° and 1050° F. at atmospheric pressure with a pour point of 130° F. and a viscosity of 64 SUS at 210° F. One hundred grams of this oil and 2 grams of isopropanol were charged into a stirred autoclave to which ethylene was introduced at an initial pressure of 1200 psig. The autoclave was brought up to a temperature of 650° F. and maintained at that temperature for a period of 5 hours, after which time the pressure of the ethylene was 400 psig. The total liquid product (116 parts by weight) recovered from the autoclave was topped to remove lighter material boiling below 650° F. to yield 90 parts by weight of product boiling above 650° F. having a viscosity of 61.4 SUS at 210° F. Both the feed and product were ketone solvent dewaxed to a pour point of 25° F. The wax removed therefrom was measured and found to be 20 wt.% of the feed but only 4 wt.% of the dewaxed product. Further, although the viscosity of the dewaxed oil was only slightly lower than that of the feed (64 SUS at 210° F.), the viscosity index was increased to 94 compared to a VI of 88 for the same feed when ketone solvent dewaxed.

EXAMPLE 2

In this example, the alkylation reaction was conducted in a 1 liter continuous tube reactor using the same feed, catalyst and feed to catalyst ratio as in Example 1. The space velocity of the feed through the reactor was 0.04 V/V/hr. (volume of feed per volume of reactor per hour), at a temperature of 675° F., under a pressure of 800 psig of ethylene and a flow rate of 0.34 standard cubic feet per hour of ethylene. 120 parts of liquid product were removed from the reactor for every 100 parts of feed. This liquid product was distilled or topped to remove material boiling below 700° F. which yielded 90 parts of alkylated product per 100 parts of feed. This product was hydrorefined over a nickel catalyst at a temperature of 500° F. in order to saturate residual olefins remaining in the product. The hydrorefined product was solvent dewaxed to a pour point of 25° F. as in Example 1 and the wax content resulting therefrom was found to be 4 wt.% compared to 20 wt.% for the feed.

EXAMPLE 3

In this example, the waxy feed was a slack wax obtained from an Arabian crude lube fraction boiling between about 800° and 1000° F. at atmospheric pressure. 100 parts of this slack wax containing 2 wt.% of isopropanol catalyst was introduced into a stirred autoclave and contacted with ethylene at a pressure of 1100 psig. The temperature in the autoclave was maintained at 670° F. for a period of 6 hours during which time the ethylene pressure dropped to about 200 psig. 120 grams of liquid product per 100 grams of waxy feed were removed from the autoclave, topped to 700° F., yield 94 grams of alkylate oil per 100 grams of wax feed. The alkylate product was solvent dewaxed to 0° F. which yielded 44 grams of oil having a viscosity of 49 SUS at 210° F., a viscosity index of 140, and a pour point of 10° F. Thus, 44% of the slack wax feed was converted to useful alkylated oil.

What is claimed is:

1. A process for alkylating normally solid, waxy hydrocarbons to liquid hydrocarbons boiling primarily in the lube oil range which comprises contacting said waxy hydrocarbons with a low molecular weight olefin and with a catalyst consisting essentially of one or more $C_3$–$C_5$ carbon atom secondary alcohols at elevated temperature and pressure to alkylate a substantial portion of the wax to relatively high VI, low pour point lube oil components.

2. The process of claim 1 wherein said olefin is selected from the group consisting of $C_2$–$C_{10}$ carbon atom olefins and mixtures thereof.

3. The process of claim 2 wherein said olefin is selected from the group consisting of $C_2$–$C_5$ carbon atom olefins and mixtures thereof.

4. The process of claim 3 wherein said waxy hydrocarbons are obtained from natural or synthetic petroleum oils.

5. The process of claim 4 wherein said elevated temperature and pressure range from between about 300° to 1000° F. and 100 to 5000 psig, respectively.

6. The process of claim 5 wherein the ratio of said catalyst to said waxy hydrocarbons ranges from about 0.1 to 10 wt.% of said waxy hydrocarbon.

7. A process for alkylating wax derived from natural and synthetic petroleum oils which comprises contacting said wax and a $C_2$–$C_{10}$ carbon atom olefin in a reaction zone at elevated temperature and pressure with a catalyst consisting essentially of one or more $C_3$–$C_5$ carbon atom secondary alcohols to alkylate a portion of said wax to relatively high VI, low pour point lube oil components.

8. The process of claim 7 wherein said elevated temperature and pressure in said zone range from about 450° to 850° F. and 200 to 1,000 psig., respectively.

9. The process of claim 8 wherein the amount of olefin in the reaction zone ranges from about 2 to 10 moles of olefin per mole of wax.

10. The process of claim 9 wherein the amount of catalyst in the reaction zone ranges from about 0.5 to 5 wt.% of the wax in said zone.

11. A process for dewaxing a wax-containing lube oil stock which comprises contacting said stock with a $C_2$–$C_{10}$ carbon atom olefin in a reaction zone at elevated temperature and pressure and with a catalyst consisting essentially of one or more $C_3$–$C_5$ carbon atom secondary alcohols to alkylate a portion of said wax to lube oil components thereby producing a lube oil stock of reduced wax content and reduced pour point.

12. The process of claim 11 wherein said elevated temperature and pressure in said zone range from about 300° to 1,000° F. and 100 to 5,000 psig., respectively.

13. The process of claim 12 wherein said olefin is a $C_2$–$C_5$ carbon atom mono-olefin.

14. The process of claim 13 wherein said stock is a lube oil raffinate.

* * * * *